US008137526B2

(12) United States Patent
Flanders et al.

(10) Patent No.: US 8,137,526 B2
(45) Date of Patent: Mar. 20, 2012

(54) METHOD OF MAKING AN ELECTROCHEMICAL NANOWIRE ASSEMBLY AND ATTACHING CELLS THERETO

(75) Inventors: Bret N. Flanders, Manhattan, KS (US); Ishan Talukdar, El Cerrito, CA (US); Birol Ozturk, Auburndale, MA (US); Prem Singh Thapa, Lawrence, KS (US)

(73) Assignee: The Board of Regents for Oklahoma State University, Stillwater, OK (US)

( * ) Notice: Subject to any disclaimer, the term of this patent is extended or adjusted under 35 U.S.C. 154(b) by 492 days.

(21) Appl. No.: 12/345,044

(22) Filed: Dec. 29, 2008

(65) Prior Publication Data

US 2009/0200170 A1 Aug. 13, 2009

Related U.S. Application Data

(60) Provisional application No. 61/017,581, filed on Dec. 29, 2007.

(51) Int. Cl.

| | |
|---|---|
| ***C25D 1/00*** | (2006.01) |
| ***C12M 1/42*** | (2006.01) |
| ***C12N 13/00*** | (2006.01) |
| ***C12Q 1/24*** | (2006.01) |

(52) U.S. Cl. ..... 205/76; 435/29; 435/30; 435/173.1; 435/285.2

(58) Field of Classification Search ..... 205/76; 435/702, 7.32, 29–30, 173.1, 285.2, 287.1
See application file for complete search history.

(56) References Cited

U.S. PATENT DOCUMENTS 5,817,472 A * 10/1998 Hardham et al. ..... 435/7.31

FOREIGN PATENT DOCUMENTS

WO WO2007/022359 2/2007

OTHER PUBLICATIONS

Travis, E. R. et al, Annual Review of Biophysics and Biomolecular Structure 1998, 27, 77-103.*
Gray, D. S. et al, Biosensors and Bioelectronics 2004, 19, 771-780.*
James, C. D. et al, IEEE Transactions on Biomedical Engineering 2004, 51, 1640-1648.*
Bangar, M. A. et al, Chemistry of Materials 2004, 16, 4955-4959.*
Obataya, I. et al, Nano Letters 2005, 5, 27-30.*
Cheng, C. et al, Nano Letters 2005, 5, 175-178.*
Llinas, R. R. et al, Journal of Nanoparticle Research 2005, 7, 111-127.*
Hafez, I. et al, Proceedings of the National Academy of Sciences of the United States of America 2005, 102, 13879-13884.*
Dong, L. et al, Nano Letters 2005, 5, 2112-2115.*
Wightman, M. R., Science 2006, 1570-1574.*
Kim, W. et al, Journal of the American Chemical Society 2007, 129, 7228-7229.*

(Continued)

*Primary Examiner* — Arlen Soderquist
(74) *Attorney, Agent, or Firm* — Fellers Snider Blankenship Bailey & Tippens, PC

(57) ABSTRACT

A method of growing a crystalline nanowire is disclosed. The method includes providing a pair of electrodes, immersing the electrode pair in a salt solution, and selectively applying a voltage signal to the electrode pair to induce growth of the nanowire between the electrode pairs.

12 Claims, 5 Drawing Sheets

A series of images showing the response of *Dictyostelium* cells, which have been cultured onto an array of lithographic electrodes, a) 0 s, b) 30 s, c) 60 s, and d) 90 s after a steady -70 mV bias was applied to the right electrode. The scale bars denote 10 μm.

OTHER PUBLICATIONS

Hallstrom, W. et al, Nano Letters 2007, 7, 2960-2965.*
Fang, K. S. et al, Journal or Cell Science 1999, 112, 1967-1978.*
Sato, M. J. et al, BioSystems 2007, 88, 261-272.*
Altomare et al., "Ultra Narrow AuPd and Al Wires," yingshe@phy.duke.edu, Mar. 2, 2007.
Berridge et al., "Calcium—a Life and Death Signal," *Nature*, Oct. 15, 1998, pp. 645-648, vol. 395, Publisher: Macmillan Publishers Ltd.
Bezryadin et al., "Self-Assembled Chains of Graphitized Carbon Nanoparticles," *Applied Physics Letters*, Mar. 5, 1999, pp. 2699-2701, vol. 74, No. 18, Publisher: American Institute of Physics.
Cantiello, "Regulation of Calcium Signaling by Polycystin-2," *Am. J. Physiol. Renal Physiol.*, 2004, pp. F1012-F1029, vol. 286, Publisher: The American Physiological Society.
Collier et al., "Calcium-Induced Calcium Release in Smooth Muscle* Loose Coupling Between the Action Potential and Calcium Release," *J. Gen. Physiol.*, Apr. 24, 2000, pp. 653-662, vol. 115, Publisher: The Rockfeller University Press.
Cui et al., "Diameter-Controlled Synthesis of Single-Crystal Silicon Nanowires," *Applied Physics Letters*, Apr. 9, 2001, pp. 2214-2216, vol. 78, No. 15, Publisher: American Institute of Physics.
Duan et al., "General Synthesis of Compound Semiconductor Nanowires," *Advanced Materials*, 2000, pp. 298-302, vol. 12, No. 4, Publisher: Wiley-VCH.
Estevez et al., "The Voltage-Gated Calcium Channel UNC-2 is Involved in Stress-Mediated Regulation of Tryptophan Hydroxylase," *Journal of Neurochemistry*, 2004, pp. 102-113, vol. 88, Publisher: International Society for Neurochemistry.
Gomer, "Diffusion of Adsorbates on Metal Surfaces," *Rep. Prog. Phys.*, 1990, pp. 917-1002, vol. 53, Publisher: IOP Publishing Ltd.
Guihard et al., "Patch-Clamp Study of Liver Nuclear Ionic Channels Reconstituted into Giant Proteoliposomes," *FEBS Letters*, 2000, pp. 234-239, vol. 476, Publisher: Elsevier Science.
Hermanson et al., "Dielectrophoretic Assembly of Electrically Functional Microwires from Nanoparticle Suspensions," *Science*, Nov. 2, 2001, pp. 1082-1086, vol. 294, No. 5544.
Huang et al., "Room-Temperature Ultraviolet Nanowire Nanolasers," *Science*, Jun. 8, 2001, pp. 1897-1899, vol. 292, Publisher: American Association for the Advancement of Science.
Ji et al., "Stretch-Induced Calcium Release in Smooth Muscle," *J. Gen. Physiol.*, May 13, 2002, pp. 533-542, vol. 119, Publisher: The Rockefeller University Press.
Jin et al., "Scalable Interconnection and Integration of Nanowire Devices Without Registration," *Nano Letters*, Apr. 10, 2004, pp. 915-919, vol. 4, No. 5, Publisher: American Chemical Soceity.
Kouklin et al., "Carbon Nanotube Probes for Single-Cell Experimentation and Assays,".*Applied Physics Letters*, 2005, pp. 173901-1-173901-3, vol. 87, Publisher: American Institute of Physics.
Larina et al., "$Ca^{2+}$ Dynamics in Salivary Acinar Cells: Distinct Morphology of the Acinar Lumen Underlies Near-Synchronous Global $Ca^{2+}$ Responses," *Journal of Cell Science*, 2005, pp. 4131-4139, vol. 118, Publisher: The Company of Biologists.
Libbrecht et al., "Electrically Induced Morphological Instabilities in Free Dendrite Growth," *Physical Review Letters*, Jul. 6, 1998, pp. 176-179, vol. 81, No. 1, Publisher: The American Physical Society.
Libbrecht et al., "Electrically Enhanced Free Dendrite Growth in Polar and Non-Polar Systems," *Physical Review Letters*, Jan. 14, 2001.
Melosh et al., "Ultrahigh-Density Nanowire Lattices and Circuits," *Science*, Mar. 13, 2003, pp. 112-115, vol. 300, No. 5616.
Monaghan et al., "Topographical Arrangement of Basement Membrane Proteins in Lactating Rat Mammary Gland: Comparison of the Distribution of Type IV Collagen, Laminin, Fibronectin, and Thy-1 at the Ultrastructural Level," *Cell Biology*, 1983, pp. 3344-3348, vol. 80, Publisher: Proc. Natl. Acad. Sci.
Morales et al., "A Laser Ablation Method for the Synthesis of Crystalline Semiconductor Nanowires," *Science*, Jan. 9, 1998, pp. 208-211, vol. 279, No. 5348.
Mycielska et al., "Cellular Mechanisms of Direct-Current Electric Field Effects: Galvanotaxis and Metastatic Disease," *Journal of Cell Science*, 2004, pp. 1631-1639, vol. 117, Publisher: The Company of Biologists.
Ozturk et al., "Reproducible Interconnects Assembled from Gold Nanorods," *Applied Physics Letters*, 2006, pp. 073108-1-173108-3, vol. 88, Publisher: American Institute of Physics.
Ozturk et al., "Single-Step Growth and Low Resistance Interconnecting of Gold Nanowires," *Nanotechnology*, 2007, pp. 1-8, vol. 18, Publisher: IOP Publishing Ltd, article 175707.
Ozturk et al., "Directed Growth of Diameter-Tunable Nanowires," *Nanotechnology*, 2007, pp. 1-10, vol. 18, Publisher: IOP Publishing, Ltd., article 365302.
Patolsky et al,, "Detection, Stimulation, and Inhibition of Neuronal Signals with High-Density Nanowire Transistor Arrays," *Science*, Aug. 25, 2006, pp. 1100-1104, vol. 313, No. 5790.
Perozo et al., "Physical Principles Underlying the Transduction of Bilayer Deformation Forces During Mechanosensitive Channel Gating," *Nature Structural Biology*, 2002, pp. 696-703, vol. 9, No. 9, Publisher: Nature Publishing Group.
Reid et al., "Wound Healing in Rat Cornea: the Role of Electric Currents," *FASEB Journal*, 2005, pp. 379-386, vol. 19.
Richardson-Burns et al., "Electrochemical Polymerization of Conducting Polymers in Living Neural Tissue," *Journal of Neural Engineering*, 2007, pp. L6-L13, vol. 4, Publisher: IOP Publishing Ltd.
Shanley et al., "Influx of Extracellular $Ca^{2+}$ is Necessary for Electrotaxis in Dictyostelium," *Journal of Cell Science*, 2006, pp. 4741-4748, vol. 119, Publisher: The Company of Biologists.
Shi et al., "Direct Synthesis of Single-Walled Carbon Nanotubes Bridging Metal Electrodes by Laser-Assisted Chemical Vapor Deposition," *Applied Physics Letters*, 2006, pp. 083105-1-083105-3, vol. 89, Publisher: American Institute of Physics.
Takahashi et al., "Preparation of Helical Gold Nanowires on Surfactant Tubules," *Chem. Comm.*, May 17, 2004, pp. 1406-1407, Publisher: The Royal Society of Chemistry.
Talukdar et al., "Directed Growth of Single-Crystal Indium Wires," *Applied Physics Letters*, 2006, pp. 221907-1-221907-3, vol. 88, Publisher: American Institute of Physics.
Thiery et al., "A Simple Technique for Staining of Cell Membranes with Imidazole and Osmium Tetroxide," *The Journal of Histochemistry and Cytochemistry*, 1995, pp. 1079-1084, vol. 43, No. 10, Publisher: The Histochemical Society, Inc.
Wang et al., "Side-by-Side Silicon Carbide—Silica Biaxial Nanowires: Synthesis, Structure,. and Mechanical Properties," *Applied Physics Letters*, Nov. 20, 2000, pp. 3349-3351, vol. 77, No. 21, Publisher: American Institute of Physics.
Whang et al., "Large-Scale Hierarchical Organization of Nanowire Arrays for Integrated Nanosystems," *Nano Letters*, 2003, pp. 1255-1259, vol. 3, No. 9, Publisher: American Chemical Soceity.
Wu et al., "Controlled Growth and Structures of Molecular-Scale Silicon Nanowires," *Nano Letters*, Feb. 3, 2004, pp. 433-436, vol. 4, No. 3, Publisher: American Chemical Society.
Xia et al., "One-Dimensional Nanostructures: Synthesis, Characterization, and Applications," *Advanced Materials*, Mar. 4, 2003, pp. 353-389, vol. 15, No. 5, Publisher: Wiley-VCH Verlag GmbH & Co.
Yoshida et al., "Dissection of Amoeboid Movement into Two Mechanically Distinct Modes," *Journal of Cell Science*, 2006, pp. 3833-3844, vol. 119, Publisher: The Company of Biologists.

* cited by examiner

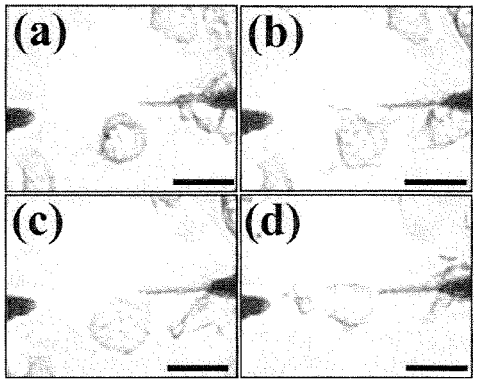

Figure 1: A series of images showing the response of *Dictyostelium* cells, which have been cultured onto an array of lithographic electrodes, a) 0 s, b) 30 s, c) 60 s, and d) 90 s after a steady -70 mV bias was applied to the right electrode. The scale bars denote 10 μm.

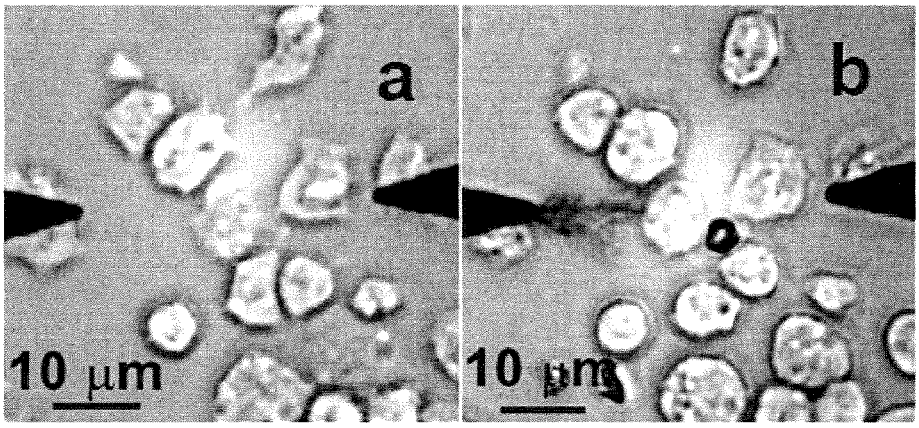

Figure 2: a) Live Dictyostelium cells on an electrode array in phosphate buffer. b) A Ni nanowire that has been grown into direct contact with one of these cells after $NiSO_4$ was added to the buffer.

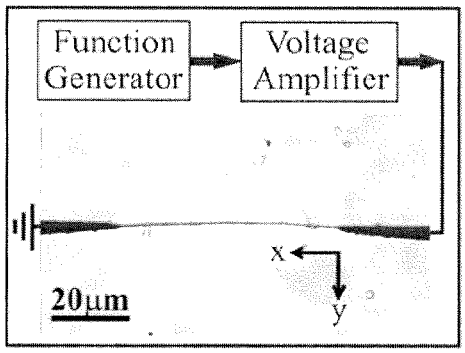

Figure 3: Diagram of the DENA apparatus. After depositing salt-solution over the electrodes, the alternating voltage applied to the right electrode induces the growth of a metallic nanowire across the gap. Attractive Properties: DENA produces single-crystal nanowires, their diameter is precisely tunable via the voltage-frequency, they are composable of many metals (Co, Ni, Pd, Pt, Cu, Ag, Au, Pb, and In) and conducting polymer, and their growth is directed.

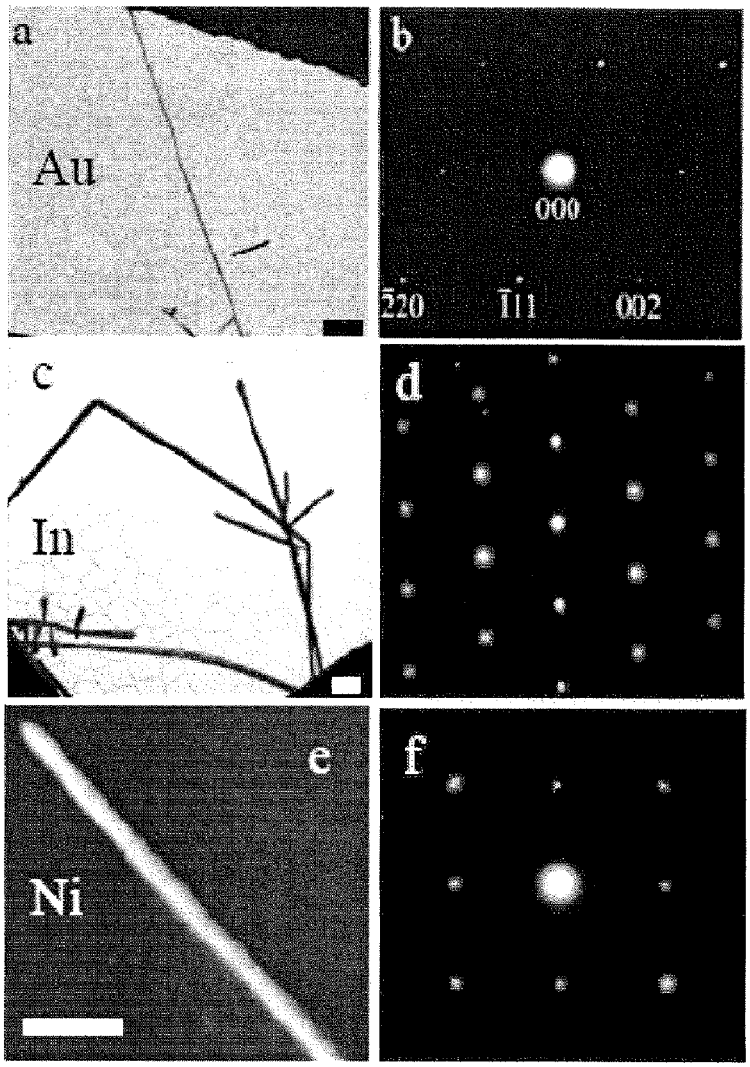
Figure 4: TEM micrographs of a) Au c) In and e) Ni nanowires and the corresponding TED patterns of the b) Au d) In and f) Ni nanowires. The Au wire has a diameter of 73 nm, the In wire has a diameter of 370 nm, and the Ni wire has a diameter of 410 nm. The scale bars denote 2μm.

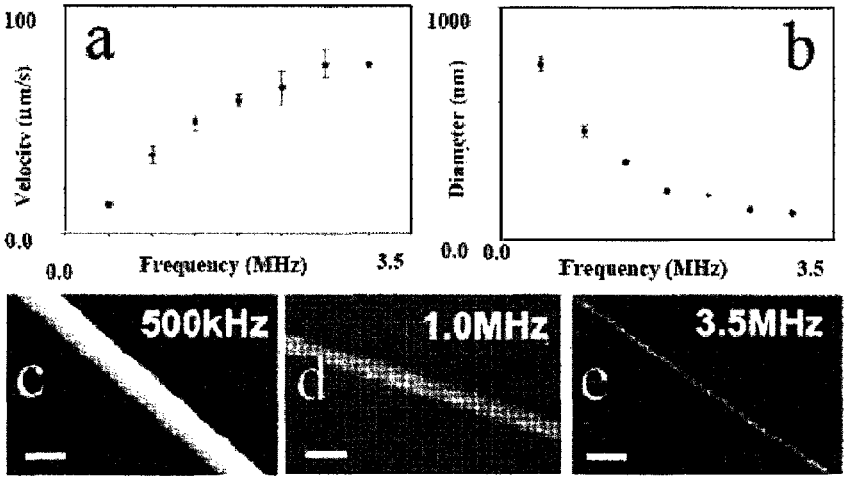

Figure 5: Frequency dependent a) growth velocity and b) diameter of In wires grown by the DENA technique. SEM images of wires grown at c) 0.500, d) 1.0, and e) 3.5 MHz. The scale bars denote 1 µm.

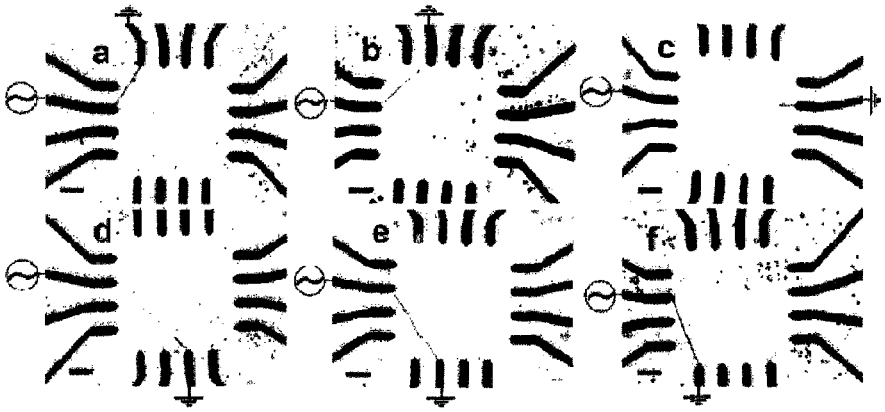

Figure 6: A series of nanowires that have been grown between user-selected electrode pairs where different pairs of alternating and grounded electrodes are selected by the user. This selection process dictates the growth-path of the wire. The scale bars denote 20 µm.

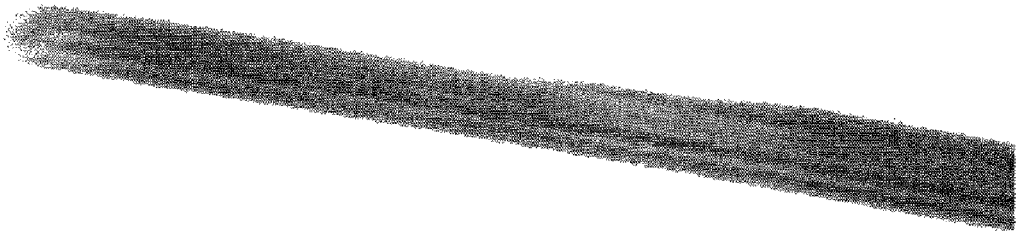
Figure 7: Au wire grown with a 50 MHz alternating voltage. The stripes denote twinning.

METHOD OF MAKING AN ELECTROCHEMICAL NANOWIRE ASSEMBLY AND ATTACHING CELLS THERETO

CROSS REFERENCE TO RELATED APPLICATIONS

This application claims priority of U.S. Provisional Patent Application No. 61/017,581, entitled "SINGLE-STEP ELECTROCHEMICAL ASSEMBLY AND INTERCONNECTING OF DIAMETER-TUNABLE NANOWIRES," filed Dec. 29, 2007, the contents of which are hereby incorporated by reference.

STATEMENT REGARDING FEDERALLY SPONSORED RESEARCH OR DEVELOPMENT

This invention was made with government support under grant numbers PHY-0646966 and ECS-0601362 awarded by the National Science Foundation. The government has certain rights in the invention.

FIELD OF THE INVENTION

This disclosure is related to cell signaling in general and, more specifically, to methods for establishing reliable signaling connections with living cells.

BACKGROUND OF THE INVENTION

Ion-mediated signaling plays a controlling role in nearly all biological processes. Presently, the patch clamp technique is the primary means of studying localized voltage-gated events in live cells. However, a significant level of expertise is required to make reliable patch clamp measurements. New techniques for cell-stimulation are in demand in the cell signaling community.

There is widespread interest in voltage-gated cellular signaling mechanisms and their associated processes and diseases. These include migraine pain, wound-healing, and possibly even metastatic disease. However, investigating such processes on the single cellular and sub-cellular levels is challenging, so new techniques for cell-stimulation are in high demand.

A large number of the processes that cells and tissue undergo are mediated by trans-membrane and intracellular ion-fluxes. *Dictyostelium* cells are of interest to the voltage-gated signaling community, in part because they are model systems for studying electric field-induced migration of the cells. In mammals, this process plays an important role in wound healing and tissue regeneration. Electric fields arise naturally in traumatized tissue and have been shown to induce the migration of human keratinocytes and corneal epithelial cells along the field gradients. Disruption of these fields impairs wound-healing. It has also been found that a reduction of the transepithelial potential in cancerous rat prostates promotes the invasion of the surrounding tissue by metastatic cells. The amoeboid *Dictyostelium* relates to these mammalian processes because *Dictyostelium* exhibits strong electrotactical behavior that is similar to that of many other cell types. It is also genetically tractable so the effects of knocking out particular receptors, chemoattractants, and channels may be characterized. Finally, *Dictyostelium* is convenient to work with because it grows well at room temperature in phosphate buffer.

Recent work on the voltage stimulated behavior of *Dictyostelium* cells has been performed by placing macroscopic electrodes adjacent to cultures in order to induce migration. A 2006 report by Shanley and co-workers showed that this approach induced all of the cells to move with roughly similar rates towards the cathode. The electrode dimensions were much larger than the cells, so the extent to which these crowded populations were responding independently to the applied field or whether a significant degree of cell-to-cell signaling played a part in this phenomenon was not clear. Stimulating single cells, as opposed to applying the voltage across the entire sample, would resolve more detail of such cellular behavior.

The difficulty of realizinig single-step growth and interconnecting of diameter tunable nanowires is a widely recognized problem in the nanotechnology community. A number of fabrication techniques provide control over the nanowire diameter. The vapor-liquid-solid method uses metallic nanodroplets to catalyze the condensation, nucleation, and axial growth of vaporous growth-material to produce pristine arrays of near single crystalline nanowires from a wide variety of materials. The size of the catalytic nanodroplets dictates the diameter of the nanowires, which can be as small as 1 nm, and influences the crystallographic direction in which the wires grow. In another approach, porous substrates, nanotubes, DNA, and other biomolecules are used as templates for the formation of nanowires with very small diameters and a wide range of intricate shapes. Here, the nanowire diameter is determined by the pore size of the template and can extend from microns down to the sub-nanometer scale. Other templating techniques use selectively etched substrates to control wire growth, enabling the fabrication of metallic nanowire arrays with sub-20 nm wire diameters and wire-to-wire separations. A fourth technique uses ultrasonic stimulation of simple salt and sugar solutions which induces the growth of metallic nanobelts. In this approach, the width of the nanobelts ranges from 8 nm to 20 nm and is controlled by the duration of the ultrasonic irradiation. With these techniques, connecting the individual wires with external instrumentation and with other submicron components is accomplished by secondary processing steps that follow the wire synthesis.

The classic approach to delivering electrical stimuli to a targeted site on a live cell is the patch-clamp technique. However, a significant level of expertise is required to perform reliable patch clamp measurements, so new techniques for cell stimulation are in demand in the cell signaling community. To this end, Lieber and co-workers have cultured nerve cells onto nanoscale electrode arrays, in order to realize multi-electrode stimulation of an individual nerve cell. However, further improvements in the ability to make reliable electrical and signaling contacts with living cells and tissues find broad applications in many areas.

Dielectrophoretic nanowire assembly exploits the voltage-induced chaining and fusing of nanoparticles into wires that span the gaps between opposing electrodes; thereby, the wire assembly and the electrode-wire contacts are accomplished in a single step. Using this technique, wires may now be grown between targeted points on the two electrodes. The transport properties of gold nanoparticle-based dielectrophoretic wires have been shown to have good reproducibility. However, the resistivity of this material is ~2000 μΩ-cm, three orders of magnitude greater than that of bulk gold. The resistive nature of these wires is due in large part to their particulate structure, as evidenced by the occurrence of the Coulomb blockade at reduced temperatures. While such materials are needed for devices like variable capacitors, the directed growth of more highly conductive, metallic wires is of obvious importance in nanoelectrictronics.

What is needed is a method for addressing the above and related issues.

SUMMARY OF THE INVENTION

The invention disclosed and claimed herein, in one aspect thereof, comprises a method of growing a nanowire. The method includes providing a pair of electrodes, immersing the electrode pair in a salt solution, and selectively applying a voltage signal to the electrode pair to induce growth of the nanowire between the electrode pairs. The voltage signal may comprise a square wave. The width of the grown nanowire may be determined by selective control of the frequency of the voltage signal. The voltage signal may be stopped when the nanowire growth has reached a region proximate a target cell. The salt solution may comprise a gold salt solution, an indium salt solution, or other chemical salts.

In another embodiment, a method of the present disclosure comprises growing crystalline nanowire. The method includes providing a salt solution, providing a first electrode in the salt solution, and providing a second electrode in the salt solution. The method further includes attaching the first electrode to a function generator, grounding the second electrode, and selectively providing a voltage signal on the first electrode using the function generator until a nanowire has grown from the first electrode to a target location. In one embodiment, the signal is a square wave with a predetermined magnitude and a selected frequency.

The predetermined magnitude of the voltage signal may be sufficiently high to allow dendritic solidification of the nanowire onto the first probe. This method may include controlling the thickness of the nanowire during growth by selective adjustment of the frequency of the voltage signal.

In some embodiments, providing a salt solution further comprises providing a salt solution with a metallic cation. The voltage signal may be halted when the nanowire has grown from the first electrode to a location in the target region sufficiently close to a living cell to allow the cell to make contact with the nanowire.

The invention disclosed and claimed herein, in another embodiment thereof, comprises growing a nanowire probe. This method includes providing a plurality of electrodes defining an inter-electrode region, and providing a salt solution in the inter-electrode gap. The method includes grounding a first one of the plurality of electrodes, and applying a voltage signal to a second one of the plurality of electrodes. The method may include halting the voltage signal when the nanowire probe has grown into a target location in the inter-electrode region. The inter-electrode region may contain at least one target cell in the target region, and the first and second electrodes may be chosen to have a connecting line intersecting the target region.

Applying a voltage signal may further comprise applying a square wave with sufficient amplitude to induce dendritic solidification of a metallic ion from the salt solution onto the first one of the plurality of electrodes. The method may further comprise selecting the diameter of the nanowire probe by selective determination of a frequency of the voltage signal.

BRIEF DESCRIPTION OF THE DRAWINGS

FIG. 1 illustrates a time lapse of a population of *Dictyostelium* cells when a negatively biased DENA-grown wire is present in the same medium as the cells: one of the cells attaches itself to the wire-tip.

FIG. 2A is a slide of live *Dictyostelium* cells on an electrode array in phosphate buffer.

FIG. 2B is a slide of a Ni nanowire that has been grown into direct contact with one of the *Dictyostelium* cells of FIG. 2 after $NiSO_4$ was added to the buffer.

FIG. 3 is a diagram of a DENA apparatus.

FIGS. 4A-4F are a series of TEM micrographs of A) Au C) In and E) Ni nanowires and the corresponding TED patterns of the B) Au D) In and F) Ni nanowires.

FIG. 5A is a graph of frequency dependent growth velocity of In wires grown by the DENA technique.

FIG. 5B is a graph of the frequency dependent growth diameter of In wires grown by the DENA technique.

FIGS. 5C-5E are SEM images of wires grown at c) 0.500, d) 1.0, and e) 3.5 MHz.

FIGS. 6A-6F are slides of a series of nanowires that have been grown between user selected electrode pairs.

FIG. 7 is a slide showing Au wire grown with a 50 MHz alternating voltage.

DETAILED DESCRIPTION OF THE PREFERRED EMBODIMENTS

Directed Electrochemical Nanowire Assembly (DENA), as described in this disclosure, is a technique for growing crystalline, metallic nanowires from macroscopic electrodes to targeted sites in an interelectrode region. This technique enables the establishment of mechanically strong wire-cell contacts, for which there is a critical need. By way of example, FIG. 1A depicts an electrode array where an indium wire has been grown from the left electrode to a point roughly halfway across the electrode gap. Several *Dictyostelium* cells are attached to an array. The panels depict this population at time delays of a) 0 seconds, b) 30 seconds, c) 60 seconds, and d) 90 seconds after a steady −70 mV bias was applied to the right electrode. The scale bars denote 5 μm. This series of images shows that contact with the *Dictyostelium* cell was made by letting the cell forage until one of its pseudopods located and attached to the negatively biased (−50 mV) wire, a process known as electrotaxis. The cell attaches itself to the electrode-tip (See FIG. 1) rather than the user enforcing contact with the cell, as in the patch-clamp technique. User-enforced contact carries a significant risk of harming the cell. Because the area of the tip can tuned to less 0.5 $\mu m^2$, the probability of contacting only one adhesion complex on the cell-surface is significant (a typical complex-density is 0.5 contacts/$\mu m^2$).

In one aspect, this disclosure provides methods to optimize wire-growth methodology (DENA) for cell signaling studies. The fundamental physics and types of electrochemistry that are amenable to the DENA-process are shown. Ultimately, the induced widespread death process in *Dictyostelium* cells is also demonstrated. The present disclosure, in some embodiments, provides a technique for the study of voltage-induced behavior and signaling in *Dictyostelium* cells. Because the DENA wires are not coupled to the cellular membrane in the same way that patch clamp pipettes would be, the DENA technique may be useful in identifying stretch-induced artifacts in patch clamp measurements on mechanically sensitive ion channels. Provided that standard university facilities are available (i.e., an optical microscope and digital camera), the methods and techniques of the present disclosure can be implemented for essentially the cost of a high frequency function generator and lithographically fabricated electrode arrays (approximately $5000, as of this writing).

The present disclosure provides a nano-electrophysiology that is based on interfacing DENA-grown wires with live cells in order to stimulate voltage-gated events at subcellular sites on individual cells. FIG. 1B shows that the blebbing of the primary cell occurred precisely at the wire-cell contact point. DENA is thereby shown to be effective for subcellular stimulation.

Using various embodiments of the DENA technique, wire growth direction may be controlled by the user to be grown into the vicinity of a targeted cell. The wires grow as highly pure, crystalline metal with a diameter that may be tuned across the 2 μm to 45 nm range. The wires may be connected to macroscopic electrodes with negligible contact resistances, so interfacing laboratory instrumentation with the wires (and, hence, the cells) is straightforward. The wires may comprise a wide variety of metals (Co, Ni, Pd, Pt, Cu, Ag, Au, Pb, and In, for example).

Essentially, the various embodiments of the DENA technique enable the voltage-induced crystallization of metallic wires from aqueous solutions of simple salts. Crystallization from solution is a complex phenomenon with several detailed sub-processes: diffusion of the metal cations to the solidification front; desolvation and reduction of the cations at the biased tip; surface diffusion of the adsorbed atoms (adatoms) to crystallization sites; and desorption back into solution.

Cation diffusion to the solidification front is the rate limiting step in certain embodiments; as the wires grow via the dendritic solidification mechanism. Dendritic solidification is a long-standing subject of interest in the soft condensed matter community. In particular, the mechanism by which external conditions fix the growth velocity and tip radius of a growing dendrite was an active research area from the 1940s through the 1990s. Stationary dendritic solidification is now well understood. However, DENA requires analysis of the non-stationary diffusion equation as described herein.

The general theory for this problem is as follows. The evolution of $\rho(r, t)$, the metal ion concentration in the solution at arbitrary position r (tip at r=0) and time t, is described by the diffusion equation:

$$\partial\rho(r,t)/\partial t=-\nabla\cdot\vec{j}. \tag{1}$$

where j is the flux of these cations.[40] j is defined by Fick's law as $$\vec{j} = -\frac{D\rho(r, t)}{k_3 T}\nabla\mu(r, t) \tag{2a}$$

where D and $\mu(r,t)$ are the diffusion coefficient and electrochemical potential of the metal species, respectively, while $k_B T$ is the thermal energy. $\mu(r,t)$ is defined as $$\mu(r,t)=k_B T \ln \rho(r,t)+zq\phi(r,t) \tag{2b}$$

where zq is the charge of a metal cation and $\phi(r,t)$ is the electric potential in solution due to the applied voltage. The rate at which the solidification front advances through the solution is the growth-velocity and is expressed by the mass conservation condition (or equation 3.2 in reference 46):[46]

$$\hat{n}\cdot j=-v(\rho_m-c_{Int} \tag{3}$$

where $\hat{n}$ is the outward-directed surface normal. $\rho_m$ is the number density of the solid metal deposit, and $c_{Int}$ is the metal cation (number) concentration at the tip-solution interface. With a few notable exceptions, almost all the work on dendritic solidification to date regards the stationary form of Equation (1) (where $\partial p/\partial t=0$). DENA is non-stationary because the growth is driven by a rapidly alternating voltage signal.

FIG. 2A illustrates live *Dictyostelium* cells attached to an electrode array in phosphate buffer, which is used commonly to maintain these cells. FIG. 2B illustrates a nickel wire that has been grown from the left electrode into contact with one of these cells. This wire was grown by the DENA technique after $NiSO_4$ was added to the cell medium (in 40 mM concentration). A ≦9 V, 37.1 MHz square wave was used to induce the wire growth. While the cells are somewhat rounder in FIG. 2B than in 2A and show less motility, replacing the medium with fresh phosphate buffer causes the cells to recover their original shape and motility on a ~10 minute time scale. Thus, wire-growth does not kill cells, but it does affect them somewhat.

The DENA technique enables the voltage-induced crystallization of metallic wires from aqueous solutions of simple salts. This occurs by nonstationary dendritic solidification mechanism, as explained above. FIG. 3 shows a diagram of the experimental apparatus used to grow near single crystalline indium wires from aqueous $In(CH_3COO)_3$ solutions. In this assembly, arrays consisting of multiple independently addressable electrodes are deposited on Pyrex substrates using standard lithographic techniques in a clean-room facility. The wire spanning the 60 μm electrode gap in FIG. 3 was grown by depositing a 10 μl drop of 55 mM aqueous $In(CH_3COO)_3$ solution over the gap and applying a 1 MHz square-wave voltage-signal with an amplitude of 8 V and no DC offset. The wire grows from the alternating electrode to the grounded electrode immediately (to the eye) after switching on the voltage. This voltage was slowly reduced as the wire approached the opposing electrode.

DENA wires may comprise a wide variety of metals. FIGS. 4A, 4C, and 4E depict transmission electron microscopy (TEM)-based images of wires grown from aqueous solutions of $HAuCl_4$, $In(CH_3COO)_3$, and $NiSO_4$, respectively. The Au wire has a diameter of 73 nm, the In wire has a diameter of 370 nm, and the Ni wire has a diameter of 410 nm. The scale bars denote 2 μm. FIGS. 4B, 4D, and 4F depict the corresponding transmission electron diffraction (TED) patterns of these wires. They are in quantitative agreement with the known diffraction patterns of crystalline Au, In, and Ni observed from the ⟨110⟩, ⟨111⟩, and ⟨001⟩ directions, respectively. This close quantitative agreement indicates that the wire shown in FIG. 4A is crystalline gold, that shown in FIG. 4C is crystalline In, and that shown in FIG. 4E is crystalline Ni. The crystal structure of grown In and Au wires tends to be invariant along wire lengths of up to 25 μm, indicating that the wires are not defect-ridden, but rather have a high degree of structural uniformity. Hence, they work well in delivering voltages to the cells as substantial voltage drops between the source and the wire-tip do not occur.

DENA nanowires are diameter tunable. As explained above, DENA is a type of dendritic solidification, so the growth velocity and the diameter of these nanowires are anti-correlated. Increasing the frequency of the alternating voltage increases the growth velocity of the nanowires (FIG. 5A). Due to the velocity diameter anti-correlation, the diameter decreases (FIG. 5B). For indium nanowires, this approach allows the diameter to be precisely tuned across the 770 to 114 nm range. For gold wires, the diameter may be tuned to as low as 45 nm (using a 50 MHz frequency). FIGS. 5C-D depict scanning electron microscopy (SEM)-based images of indium wires grown at 500 kHz, 1.0 MHz, and 3.5 MHz, respectively. The scale bars denote 1 μm.

In one embodiment, the electrotactical behavior of *Dictyostelium* cells is exploited in order to establish contact. *Dictyostelium* cells attach themselves to negatively biased electrodes. Therefore, the cell in FIG. 1A was contacted by first growing an indium nanowire half-way across the cell gap. The salt solution was then washed away and replaced with a drop of phosphate buffer in which the cells were suspended. After 20 minutes, the cells had attached to the surface. A steady −50 mV bias was applied to the wire. In foraging for food, the nearest cell found the wire and migrated to its tip. It remained attached there throughout the rest of the experiment (several minutes). It should also be noted that in this approach, the user does not manually force the wire into contact with the cell, which could harm the cell. Rather, the cell finds the wire and chooses for itself how to make contact. This remarkable behavior circumvents the potentially difficult task of the user adequately contacting the cell. In an experiment where 38 wire-cell interfacing events performed in this way, the cells attached to and remained at the wire tip, where the negative charge density is largest, 38 times. Thus, this approach enables reproducible electrical contacts to be made with a single cell.

By exploiting non-stationary dendritic solidification, the DENA technique attains some properties that are useful for growing nanowires in micro-electronic circuitry. In particular, the wire diameters are easily and precisely tunable, and the wires can be grown along user-specified paths. The latter is especially important, enabling the wires to be connected to external circuitry or other micron-sized targets, including live cells.

Adjusting the voltage frequency provides diameter control in the DENA technique because smaller frequencies induce slower growth and the growth velocity and wire diameter are anti-correlated (a basic property of dendritic solidification). Therefore, small frequencies give stout (e.g., thick) wires while large frequencies give slender (e.g., thin) wires. For example, this range is ~1-4 MHz for indium versus 20-50 MHz for gold. DENA is a diffusion limited process, so it is reasonable that the cation diffusivities will strongly influence the growth rate (and also the diameter): metals whose cations have large diffusivities should grow faster than those with small diffusivities.

FIGS. 6A-F depict lithographic electrode arrays on which a different pair of electrodes is selected in each image (the scale bars denote 20 μm). Selection comprises applying an alternating voltage to one electrode (the second down on the left of each image) and grounding the other. Nothing is done to the remaining electrodes in the array. Six different pairs are selected in FIGS. 6A-F, and the wire grows from the alternating to the grounded electrode. The wires are within ≦3.0 μm of the ideal tip-to-tip straight line paths at all points between electrodes. This capability is useful in the proposed studies because it constitutes a means of growing a wire from an electrode to a cell, or near a cell, that is attached to the glass in the interelectrode gap. By choosing an electrode pair whose connecting line intersects the targeted cell, a wire may be grown from the alternating electrode up to that site.

Directional growth capability of the DENA technique is due in part to a long range electric potential that grows in during wire growth. This potential can be used to guide the growth path of the wire. Two features of the DENA approach underlie this long range potential. First, the ions near the biased electrode rearrange to screen the applied voltage over a very short distance. This is the Debye-Hückel effect; the screening distance λD is ~1 nm for salt solution like aqueous 55 M $In(CH_3COO)_3$. This result suggests that long range directional growth would not be possible because the voltage is fully screened a short distance from the electrode.

An attractive feature of The DENA technique is that the wires can be grown as near single crystals. We have shown this for indium nanowires grown via a 1.0 MHz square wave voltage. As explained elsewhere, much less than one monolayer of In atom coverage is deposited per (500 ns) negative half cycle. The atoms then have another 500 ns to surface-diffuse and crystallize before the next wave of In atoms is deposited. These off periods, which punctuate the growth process, provide time for the newly deposited adatom population to execute the attachment kinetics required for well ordered crystallization. This idea suggests that growth with shorter off periods (higher frequencies) would be detrimental to single crystal formation. Indeed, Au wires grown with much higher frequencies, ~50 MHz, exhibit more complex microstructure, as shown in the transmission electron micrograph in FIG. 7. The 17 nm diameter wire has five contrasting (lengthwise) stripes, reflecting variation in the crystalline structure of the nanowire due to twinning or, perhaps, more severe perturbations. We have observed similar structures in Ni wires. These Au and Ni wires are not single crystals.

As an example, we have employed the DENA technique to establish electrical contact with single *Dictyostelium* cells that were cultured onto electrode arrays. This capability allows voltage stimulation studies to be made on the single cellular and sub-cellular levels. Delivery of a steady −80 mV voltage to the wire-cell contact point was found to induce a physiological response at that site: a spherical deformation of the cellular membrane grew out of and shrunk back into the cell over a ~20 s period. This response is likely to be blebbing, which is believed to play a vital role in cell motility.

In the present embodiments, a square waveform appears to be important to the DENA technique, as growth does not occur when sinusoidal or saw-tooth waveforms are applied. Most likely, this phenomenon is because ion-transport to the solidification front during each half cycle takes a certain amount of time, and the square waveform supplies the full voltage amplitude during the entire half cycle. Sinusoidal and saw-tooth waveforms do so only during the peak of a half cycle. Thus, the square waveform of a given frequency supplies the maximum voltage for longer periods of time than other waveforms, so it is more efficient at inducing deposition. Additionally, the use of duty cycles not equal to 50% results in rapid electrode-dissolution, thereby preventing wire growth. For indium, wire growth occurs across the 0.5 MHz to 3.5 MHz range.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A method of growing a nanowire comprising:

providing a pair of electrodes;

immersing the electrode pair in a directed electrochemical nanowire assembly (DENA) compatible salt solution;

selectively applying a voltage signal to the electrode pair to induce growth of the nanowire between the electrode pairs; and applying a negative electrical bias to one of the electrodes to stimulate self attachment of a living cell to the nanowire.

2. The method of claim 1, wherein the voltage signal comprises a square wave.

3. The method of claim 1, further comprising selecting the width of the grown nanowire by selective control of the frequency of the voltage signal.

4. The method of claim 1, wherein the salt solution comprises a gold salt solution.

5. The method of claim 1, wherein the salt solution comprises an indium salt solution.

6. A method of growing crystalline nanowire, comprising:

providing a metal salt solution where the metal is selected from the group consisting of: cobalt, nickel, palladium, platinum, silver, gold, lead, and indium;

providing a first electrode in the salt solution;

providing a second electrode in the salt solution;

attaching the first electrode to a function generator;

grounding the second electrode;

selectively providing a voltage signal on the first electrode using the function generator until a nanowire has grown from the first electrode to a target location near a living cell; and applying a negative bias to the first electrode to stimulate self attachment of the living cell to the first electrode;

wherein the signal is a square wave with a predetermined magnitude and a selective frequency.

7. The method of claim 6, further comprising controlling the thickness of the nanowire during growth by selective adjustment of the frequency of the voltage signal.

8. The method of claim 7, wherein the predetermined magnitude of the voltage signal is sufficiently high to allow dendritic solidification of the nanowire onto the first probe.

9. A method of growing a nanowire probe, comprising:

providing a plurality of electrodes defining an inter-electrode region;

providing a directed electrochemical nanowire assembly (DENA) compatible salt solution in the inter-electrode region;

grounding a first one of the plurality of electrodes;

applying a voltage signal to a second one of the plurality of electrodes to grow the nanowire probe into the inter-electrode region proximate a living *Dictyostelium* cell; and applying a negative bias to the second one of the plurality of electrodes to stimulate self attachment of the *Dictyostelium* cell to the second of the plurality of electrodes.

10. The method of claim 9, further comprising removing the salt solution and providing a buffer solution after growing the nanowire probe.

11. The method of claim 9, wherein applying a voltage signal further comprises applying a square wave with sufficient amplitude to induce dendritic solidification of a metallic ion from the salt solution onto the first one of the plurality of electrodes.

12. The method of claim 9, further comprising selecting the diameter of the nanowire probe by selective determination of a frequency of the voltage signal.

* * * * *